US008967388B1

(12) United States Patent
Parsons et al.

(10) Patent No.: US 8,967,388 B1
(45) Date of Patent: Mar. 3, 2015

(54) VECTOR SLOT

(71) Applicant: Polydeck Screen Corporation, Spartanburg, SC (US)

(72) Inventors: Steven Craig Parsons, Louisa, KY (US); Luke Edward Langner, Greenville, SC (US); Mark Vincent Weaver, Columbus, NC (US); Jerrel D. Warren, II, Gaffney, SC (US); Gregory D. Anderson, Spartanburg, SC (US); Samuel Michael Durnavich, Denver, CO (US)

(73) Assignee: Polydeck Screen Corporation, Spartanburg, SC (US)

( * ) Notice: Subject to any disclaimer, the term of this patent is extended or adjusted under 35 U.S.C. 154(b) by 0 days.

(21) Appl. No.: 14/103,964

(22) Filed: Dec. 12, 2013

(51) Int. Cl.
*B07B 1/49* (2006.01)
*B07B 1/46* (2006.01)

(52) U.S. Cl.
CPC ..... *B07B 1/4654* (2013.01)
USPC ..... 209/393; 209/405; 209/412

(58) Field of Classification Search
USPC ..... 209/352, 392, 393, 405, 412
See application file for complete search history.

(56) References Cited

U.S. PATENT DOCUMENTS

| | | | | |
|---|---|---|---|---|
| 340,484 | A * | 4/1886 | Carrico | 209/273 |
| 2,301,514 | A | 11/1942 | Brewster | |
| 4,374,169 | A | 2/1983 | Gryskiewicz et al. | |
| 5,927,511 | A | 7/1999 | Riddle et al. | |
| 8,196,753 | B2 | 6/2012 | Freissle | |
| 2003/0012833 | A1 | 1/2003 | Freissle et al. | |
| 2009/0223876 | A1 | 9/2009 | Burnett et al. | |
| 2010/0307961 | A1 | 12/2010 | Van Rensburg | |
| 2013/0126397 | A1 | 5/2013 | Ghosh | |

OTHER PUBLICATIONS

Profile Wire Screen—www.completionproducts.com/design_technology.html—1 page.

* cited by examiner

*Primary Examiner* — David H Bollinger
(74) *Attorney, Agent, or Firm* — Dority & Manning, P.A.

(57) ABSTRACT

A screening panel and screening arrangement are provided for screening materials. The screening panel includes a peripheral frame having a first side frame member and an opposing second side frame member defining an opening therebetween. Further, the screening panel includes a plurality of spaced elongated screening ribs defining a screening surface of the screening panel. The screening panel includes a one or more sets of screening ribs that extend continuously across at least a portion of the screening surface of the screening panel in a non-parallel direction relative to a flow direction of material in the screening arrangement.

16 Claims, 10 Drawing Sheets

VECTOR SLOT

FIELD

The present disclosure relates generally to screening panels, and more specifically to screening panels that include angled ribs configured to be arranged in a non-parallel direction relative to the flow of materials to facilitate screening materials.

BACKGROUND

Screening arrangements are used in the mining and similar industries to size and separate, or screen, particulate materials. Certain screening arrangements include modular screening systems which are composed of a plurality of modular and replaceable components, such as screening panels. The screening panels are mounted on the screening arrangement to define an overall screening surface. The overall screening surface of the screening arrangement is made up of the individual screening surfaces of the screening panels.

Current screening panels generally include a plurality of ribs or surface features extending across an opening. The ribs define the screening surface through which particulate material is directed. During a typical screening process, the screening arrangement is vibrated and particulate material is deposited on it. The configuration and vibration is such that the material migrates in a preferential feed direction on the screening arrangement. More specifically, the screening openings allow smaller material particles to pass through the screening surface while larger material particles are prevented by the ribs from passing through the screening surface, thereby achieving desired sizing separation of the material.

Certain screening panels, however, can suffer several disadvantages. For example, the surface features of certain screening panels can have flat, planar surfaces. These flat surfaces may prevent particulate materials from being properly screened. For example, when the feed direction is parallel to the planar ribs or surface features, relatively smaller material particles which should desirably pass through the screening surface may become entrained on the planar surface, in the direction of flow, and experience difficulty passing through the screening surface. Likewise, irregularly-shaped particles having similar dimensions to the spacing between the ribs and/or surface features may become lodged in the spacing while traveling in a parallel direction, blocking passage of the particles that could travel through the openings.

In addition, the ribs or surface features may stretch or deform, thereby blocking materials that would otherwise pass through the screening surface. For example, the flexibility and shape of the ribs, as well as their geometrical relationship to one another, may allow them to flex excessively apart from one another, effectively expanding the screening openings to a size which allows particles that are unacceptably large to pass through.

Thus, a need exists for a screening panel that allows for more efficient screening of materials by interrupting the parallel relationship between the feed travel direction and the orientation of the surface features and/or ribs, as well as by strengthening the surface features relative to feed direction.

BRIEF DESCRIPTION

Aspects and advantages of the invention will be set forth in part in the following description, or may be obvious from the description, or may be learned through practice of the invention.

In one example aspect, a screening panel is provided for screening materials. The screening panel includes a peripheral frame having a first side frame member and an opposing second side frame member and a plurality of spaced elongated screening ribs defining a screening surface of the screening panel. The plurality of screening ribs includes a first set of screening ribs and a second set of screening ribs. The first set of screening ribs extends from the first side frame member of the peripheral frame towards a transition portion of the screening surface in a first direction. The second set of screening ribs extends from the transition portion towards the second side frame member of the peripheral frame in a second direction, wherein the first direction is different than the second direction.

In another example aspect, a screening arrangement is provided for screening materials. The screening arrangement includes a support structure having a plurality of support members mounted in a parallel relationship to each other and a plurality of screening panels mounted on the support members. Each of the screening panels includes a peripheral frame having a first side frame member and an opposing second side frame member and a plurality of spaced parallel elongated screening ribs defining a screening surface of the screening panel. The plurality of screening ribs extends continuously across at least a portion of the screening surface of the screening panel in a non-parallel direction relative to a flow direction of the screening arrangement.

In still another aspect, a screening panel for screening materials is disclosed. The screening panel includes a peripheral frame having opposing first and second side frame members and opposing first and second end frame members. The frame members define an opening therebetween. The screening panel further includes a plurality of spaced parallel elongated screening ribs defining a screening surface of the screening panel. The plurality of screening ribs extend continuously across at least a portion of the screening surface in a direction that is diagonal relative peripheral frame.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
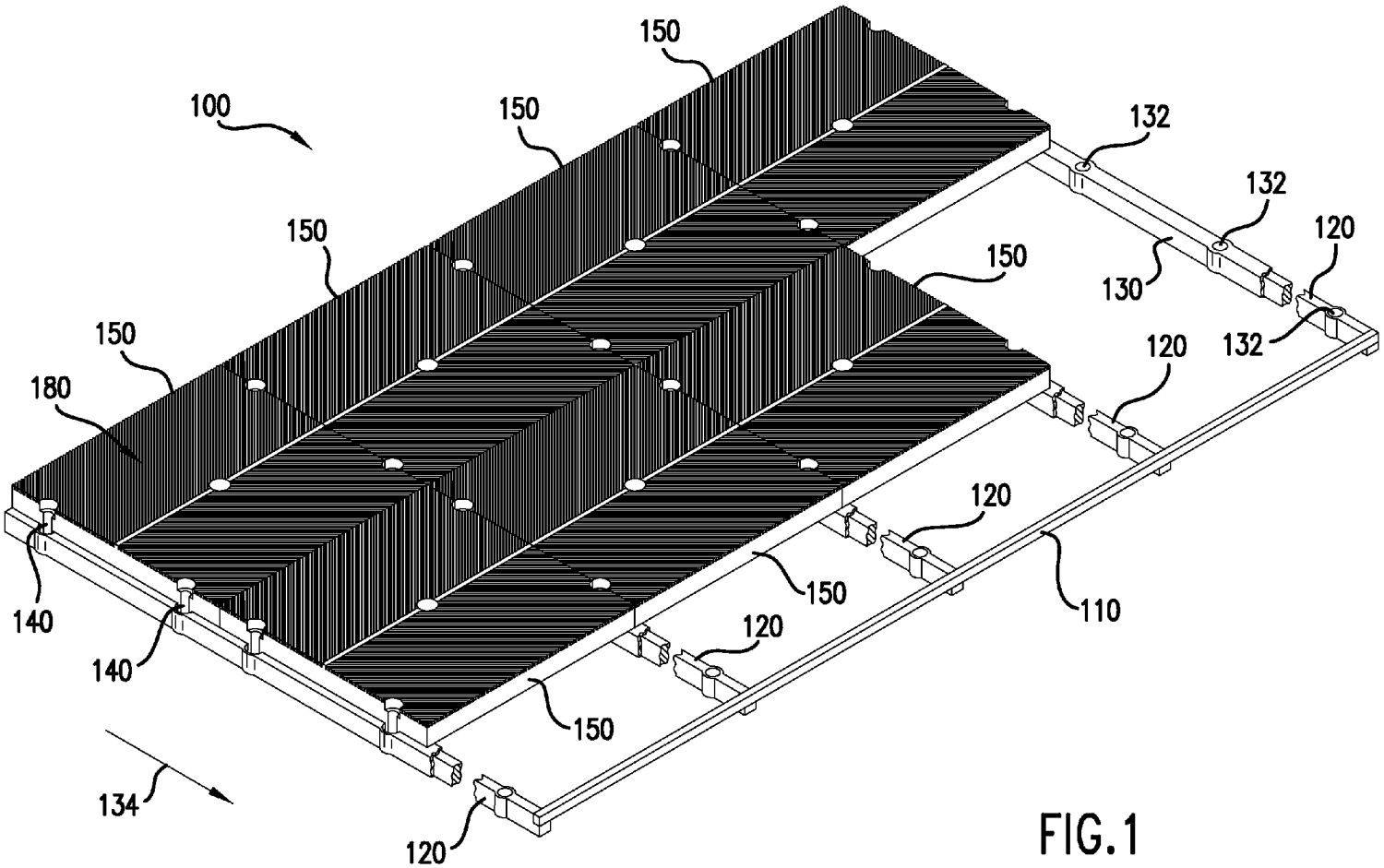
FIG. 1 illustrates a perspective view of one embodiment of a screening arrangement according to example aspects of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to a screening panel and corresponding screening arrangement. The screening panel can include a peripheral frame having opposing first and second side frame members and opposing first and second end frame members defining an opening therebetween. The screening panel can include a plurality of closely spaced elongated screening ribs defining a screening surface that generally directs materials towards and through the opening of the screening panel. According to example aspects of the present disclosure, the screening panel can include one or more sets of screening ribs that extend continuously across the screening surface of the screening panel in a non-parallel direction relative to a flow direction of materials in a screening arrangement.

In this manner, the screening panels according to example aspects of the present disclosure can be arranged in a screening arrangement such that the screening ribs are neither with nor against flow of particulate materials across the screening panel. In this way, the screening panels are capable of improving the throughput of material particles by reducing build-up of materials, such as debris or irregularly-shaped, near-size feed particles, which may become lodged in the screening panel during the screening process.

For instance, in one example embodiment, the screening panel can include a first and second set of screening ribs. The first set of screening ribs can continuously extend diagonally from the first side frame member at an acute angle towards the first end frame member. The second set of screening ribs can continuously extend diagonally at a different acute angle towards the second end frame member.

More or fewer sets of screening ribs arranged in a non-parallel direction relative to a flow direction of a screening arrangement can be included in the screening panel without deviating from the scope of the present disclosure. For instance, the screening panel can include a single set of screening ribs extending in a non-parallel direction relative to a flow direction of a screening arrangement. Adjacent screening panels can be arranged on a screening arrangement such that adjacent screening ribs on adjacent screening panels extend in different directions. In another example embodiment, the screening panels can have three, four, five, or any other suitable number of sets of screening ribs extending in non-parallel direction relative to a flow direction of materials in a screening arrangement.

Referring now to the drawings, FIG. 1 illustrates a perspective view of one embodiment of the screening arrangement 100 according to an example embodiment of the present disclosure. As shown, the screening arrangement 100 includes a support frame 110 that includes a plurality of support members 120 mounted in parallel relationship to one another. The support frame 110 may be composed of any suitable material capable of supporting the screening panels 150, such as, for example, steel or aluminum. The support frame 110 supports a plurality of screening panels 150 as described herein, which are used to separate and size material. The screening panels 150 may be arranged in any suitable configuration on the support frame 110. For example, in one embodiment, the screening panels 150 are arranged such that the ribs 180 of adjacent screening panels 150 extend in different directions. More specifically, as shown in FIG. 1, the screening panels 150 are arranged such that ribs 180 of adjacent screening panels 150 are traverse to each other.

In further embodiments, the support members 120 can include a plurality of openings or sockets 132 for receiving one or more securing elements 140 of the screening panels 150. More specifically, the sockets 132 may be spaced at regular intervals or at irregular intervals along the length of the support members 120. The securing elements 140 can be secured within the sockets 132 in a variety of ways. For example, the securing element 140 can be secured to support member 120 by a screw thread. In other embodiments, the securing element 140 can be snapped into support member 120.

The screening arrangement 100 can further include a plurality of protective covers 130 mounted in a side-by-side relationship along the length of the support members 120. The protective covers 130 can be used to protect support members 120 from abrasion during the screening process. Further, the protective covers 130 can be formed from a variety of resilient materials that are resistant to abrasion, such as a high wear resistant polymer, such as polyurethane.

Figure 6:
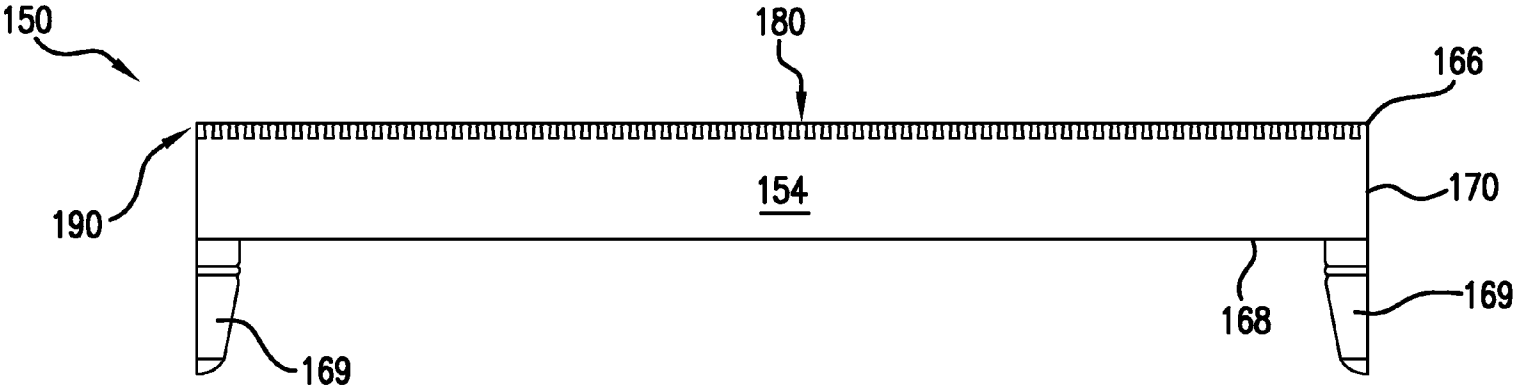
FIG. 6 illustrates a first side view of the screening panel of FIG. 2.
Figure 7:
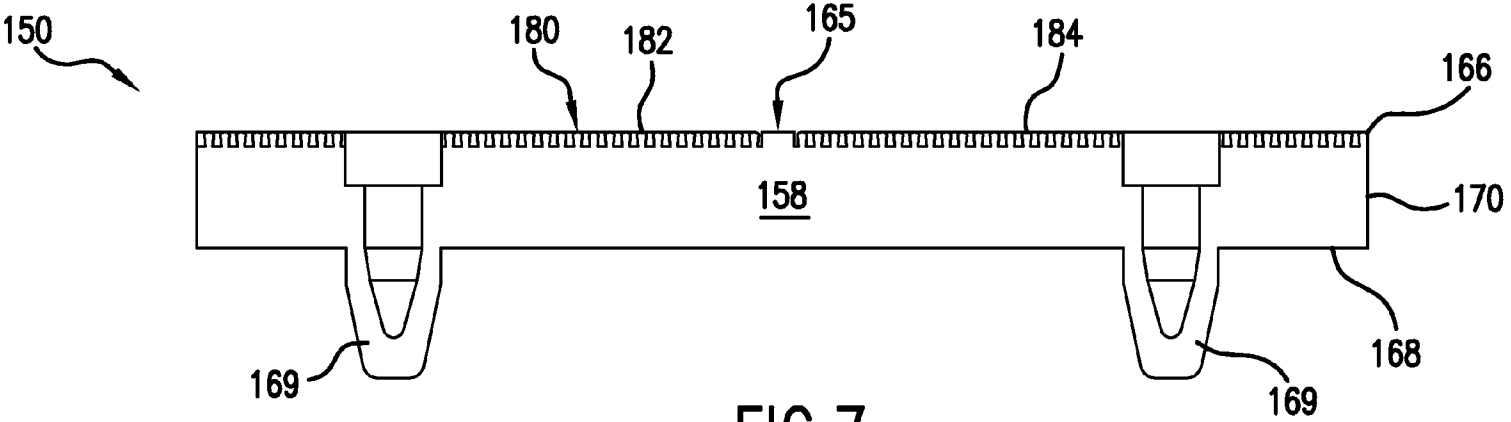
FIG. 7 illustrates a second side view of the screening panel of FIG. 2.

Referring now to FIGS. 2-9, various views of one example embodiment of a suitable screening panel 150 according to example aspects of the present disclosure are illustrated. As shown, the screening panel 150 may include a peripheral frame 152. In the illustrated embodiment, the peripheral frame 152 includes a pair of opposing side frame members 154, 156 and a pair of opposing end frame members 158, 160. Thus, the frame members 154, 156, 158, 160 define an opening 172 therein. In one embodiment, the side frame members 154, 156 may be integral with the end frame members 158 and 160. Alternatively, the side frame members 154, 156 may be separate features from the end frame members 158, 160 and mounted thereto. In addition, as shown in the illustrated embodiment, the frame members 154, 156, 158, 160 may also define corners 161, 162, 163, 164 of the peripheral frame 152. Thus, the peripheral frame 152 may have a generally rectangular or square frame. It should be understood, however, that the peripheral frame 152 is not limited to a rectangular or square frame, but may be a triangular frame, a circular or oval frame, or a frame with any polygonal shape. In addition, as shown in FIGS. 6 and 7, the peripheral frame 152 may also have an upper surface 166, a lower surface 168, and an outer peripheral surface 170. The outer peripheral surface 170 may generally interconnect the upper surface 166 and the lower surface 168 so as to form a border of the peripheral frame 152.

Figure 2:
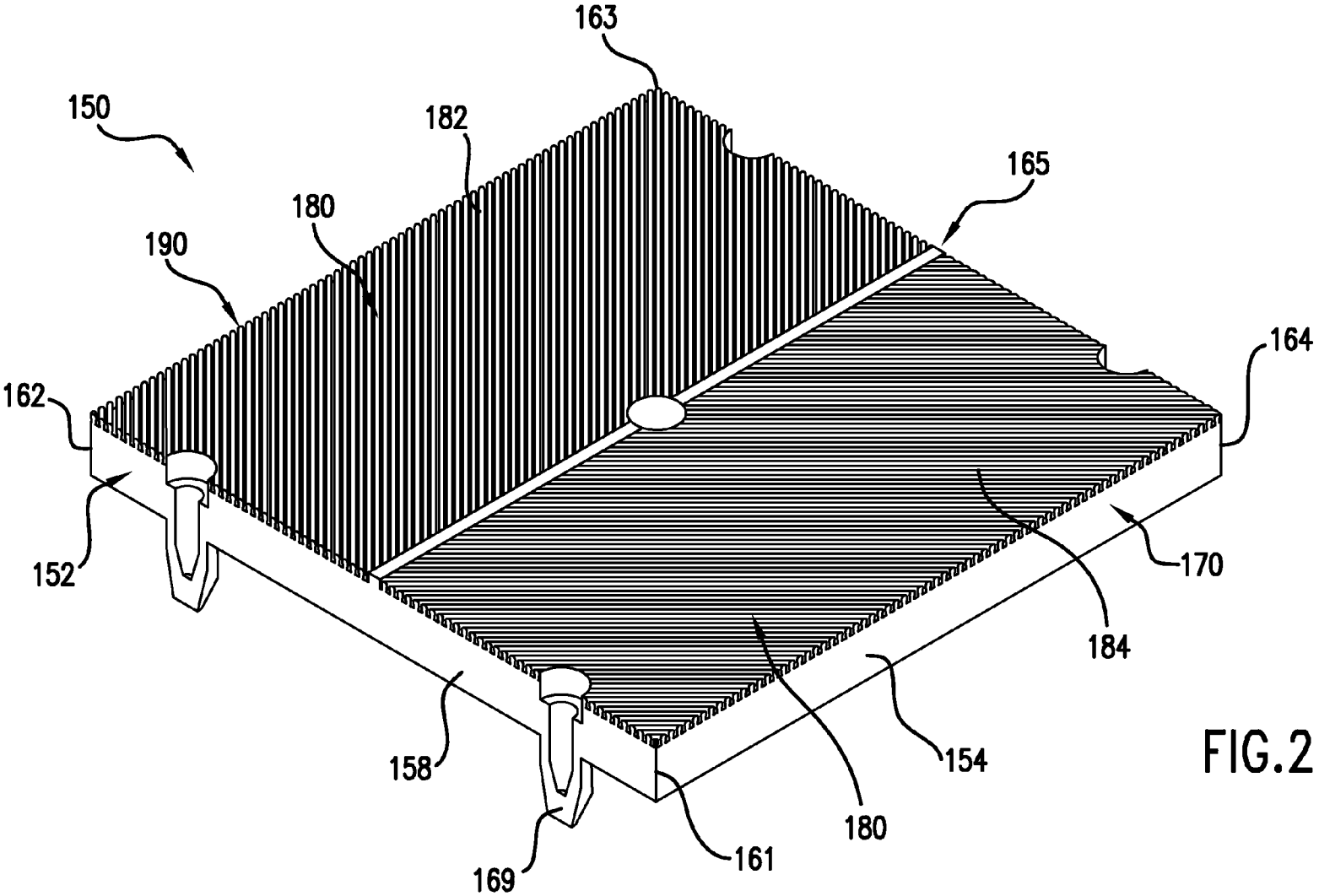
FIG. 2 illustrates a perspective view of one embodiment of a screening panel according to example aspects of the present disclosure.
Figure 3:
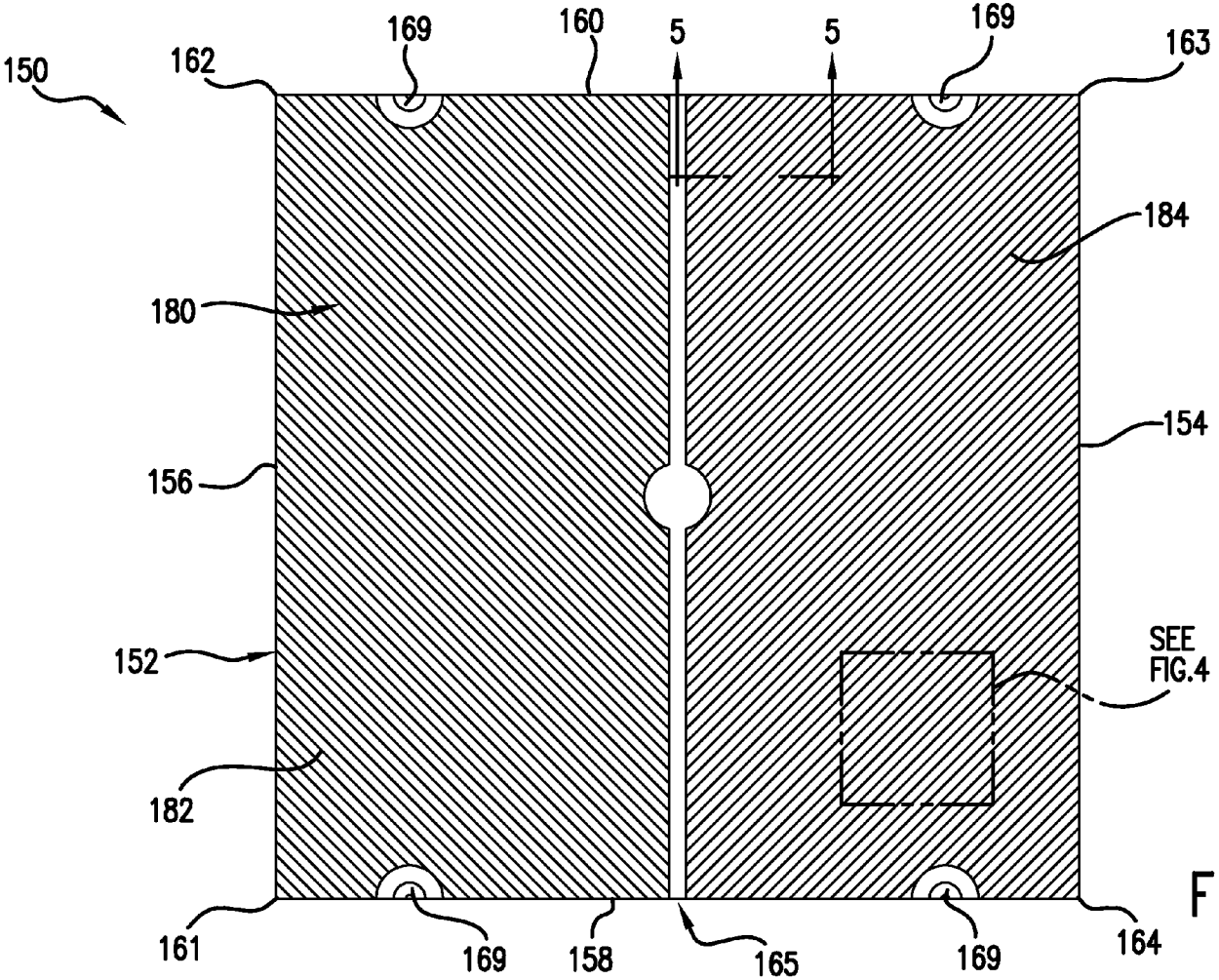
FIG. 3 illustrates a top view of the screening panel of FIG. 2.
Figure 4:
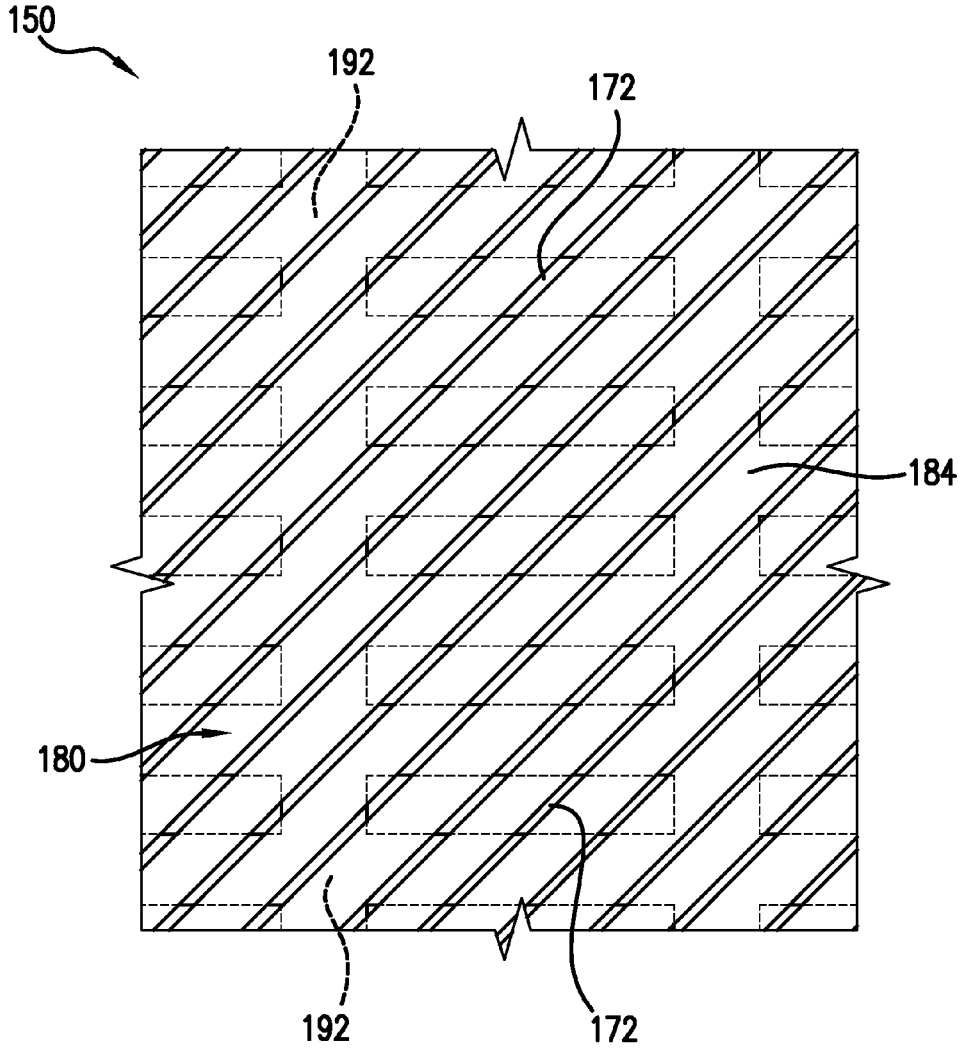
FIG. 4 illustrates a detailed view of a portion of the screening panel of FIG. 3 as indicated by the dotted lines.
Figure 5:
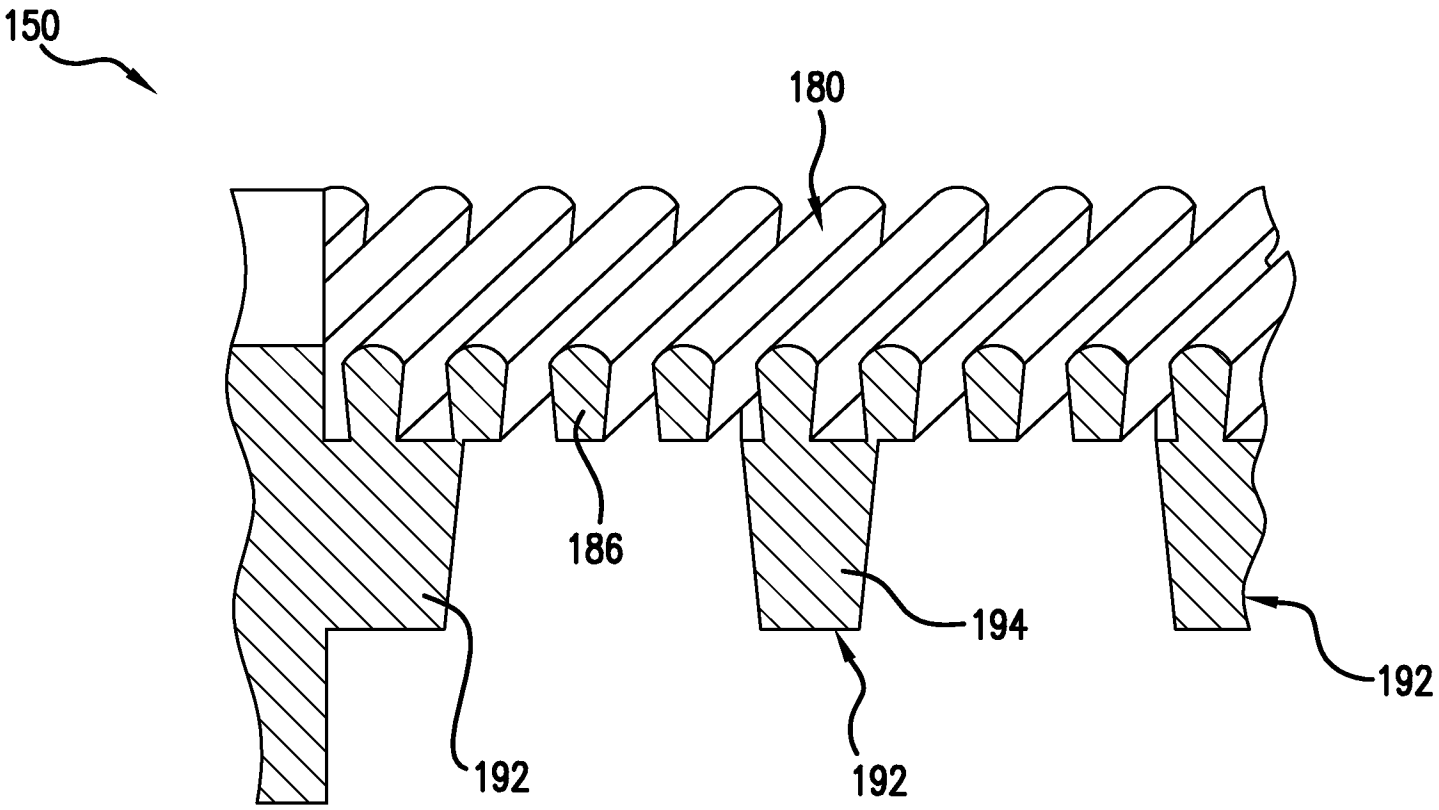
FIG. 5 illustrates a cross-sectional view of the screening panel of FIG. 2 along line 5-5.

As mentioned, and referring to FIGS. 2-4, the screening panel 150 may further include a plurality of screening ribs 180 defining a screening surface 190 that is configured to facilitate the screening of material (not shown) through the screening panel 150. For example, the screening ribs 180 may direct materials, such as particulate materials, towards and through the screening surface 190 of the screening panel 150. In the illustrated embodiments, for example, the screening ribs 180 extend continuously across at least a portion of the opening 172 of the screening panel 150 in a generally diagonal direction relative to one or more of the frame members 154, 156, 158, 160. Further, the screening ribs 180 can be generally straight, linear ribs having an elongated rectangular-shaped configuration. In addition, the screening ribs 180 may also have varying widths and/or lengths.

The plurality of screening ribs 180 can include a first set 182 of screening ribs and a second set 184 of screening ribs. The first set of screening ribs 182 and the second set of screening ribs 182 may be included in the screening panel 150 in a variety of configurations. For example, in one embodiment, each of the first set of screening ribs 182 may be generally parallel to one another and may extend from the first side frame member 156 of the peripheral frame 152 towards a transition portion 165 of the screening surface 190 in a first direction. Similarly, each of the second set of the screening ribs 184 may be generally parallel to one another and may extend from the transition portion 165 towards the second side frame member 154 of the peripheral frame 152 in a second direction. The transition portion 165 can be located at any suitable point on the screening panel 150. Further, as shown particularly in FIGS. 2 and 3, the first direction of the first set 182 of screening ribs 180 is different than the second direction of the second set 184 of screening ribs 180.

More specifically, the first set 182 of screening ribs 180 can extend generally diagonally from the first side frame member 152 at an acute angle from the first side frame member 152 towards the first end frame member 158. Similarly, the second set 184 of screening ribs 180 can extend generally diagonally from the transition portion 165 at an acute angle towards the second end frame member 160. In a particular embodiment, for example, the first set 182 of screening ribs 180 can extend at a generally 45-degree angle from the first side frame member 156 towards the first end frame member 158, whereas the second set 184 of screening ribs 180 can extend at a generally 45-degree angle from the transition portion 165 towards the second end frame member 160. In such an embodiment, the first 182 and second 184 set of screening ribs 180 are traverse to each other.

In further embodiments, the second direction of the second set 184 of screening ribs 180 extends at an angle greater than 0 degrees but less than 180 degrees relative to the first direction of the first set 182 of screening ribs 180. In addition, the transition portion 165 may separate the first 182 and second set 184 of screening ribs 180. In additional embodiments, the transition portion 165 may be purposefully molded into the screening panel 150 or may be indirectly molded into the screening panel 150 as a result of molding the first 182 and second 184 set of screening ribs 180 into the screening panel 150. In an alternative embodiment, the transition portion 165 can simply be the point at which the first 182 and second set 184 of screening ribs directly connect with each other.

The various configurations of the screening ribs 180 as described herein allows the screening panel 150 to be oriented in a screening arrangement 100 such that the screening ribs 180 are at an angle that is neither with flow nor against flow (e.g. is non-parallel to the direction of flow of material). For example, as depicted in FIG. 1, the screening ribs 180 of each screening panel 150 are configured at an angle relative to the flow direction 34 to channel the screening materials along a meandering path that improves throughput of the screening materials. For example, if a near size particle follows the pattern of example embodiments of the present disclosure, the particle will travel farther than if traveling along a traditional screening panel.

Figure 8:
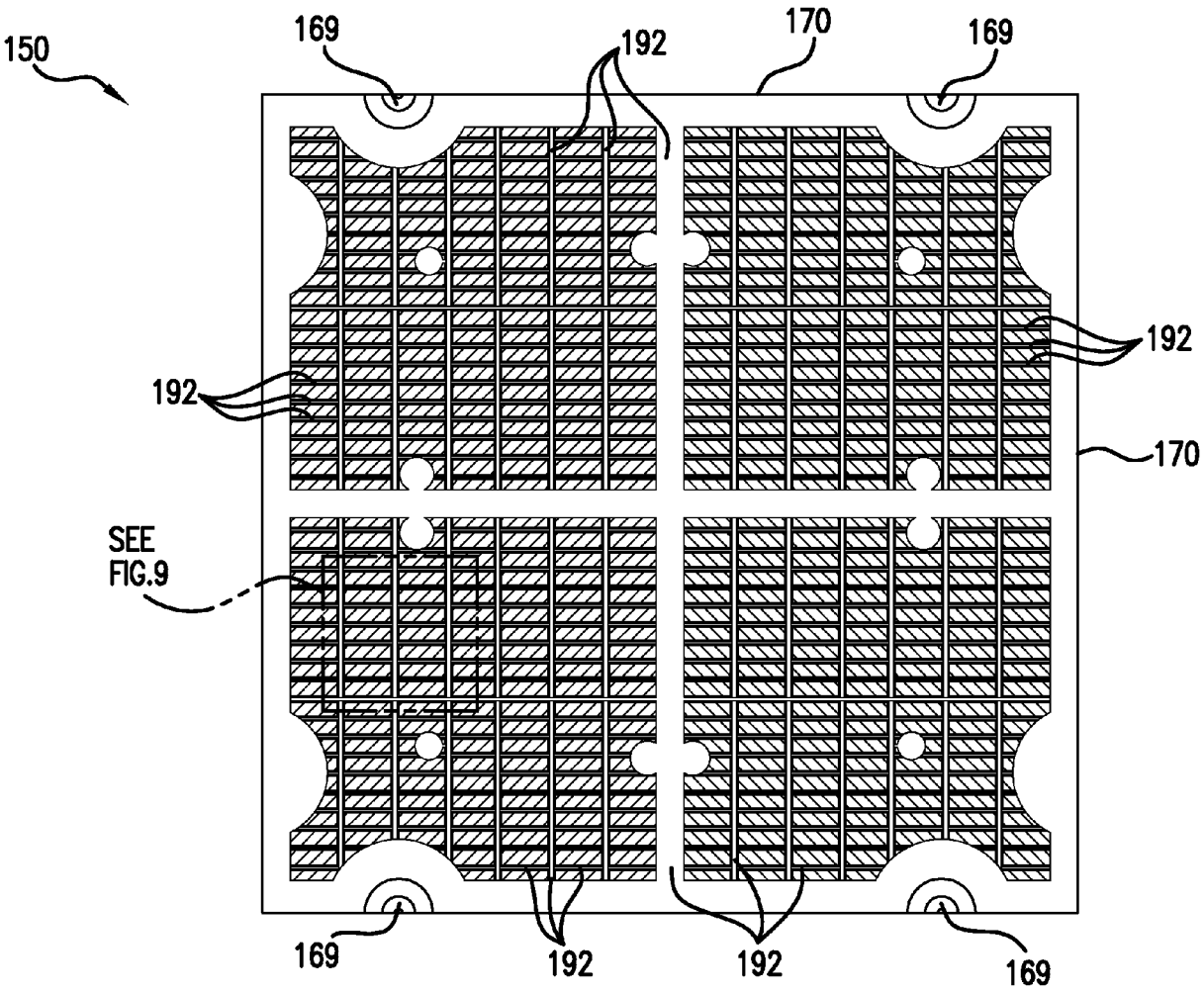
FIG. 8 illustrates a bottom view of the screening panel of FIG. 2.
Figure 9:
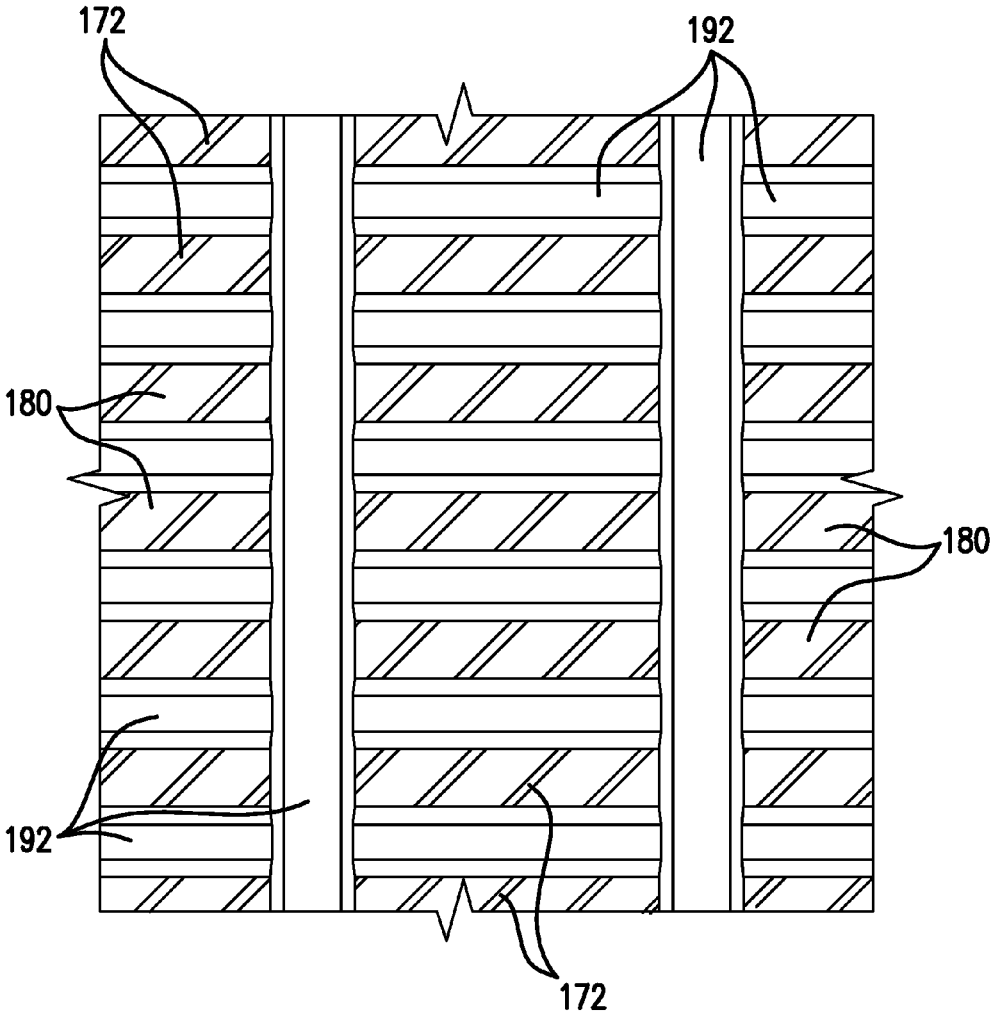
FIG. 9 illustrates a detailed view of a portion of the screening panel of FIG. 8 as indicated by the dotted lines.

Referring now to FIGS. 8 and 9, the screening panels described herein may further include a plurality of elongated support ribs 192 supporting the plurality of screening ribs 180. As such, the screening ribs 180 are more rigid, thereby limiting the ability or tendency of the screening ribs 180 to be stretched open or pushed closed along their length. Further, as shown particularly in the embodiment of FIG. 9, the plurality of support ribs 192 extend in a different direction than the screening ribs 180. In one embodiment, for example, the plurality of screening ribs 180 and the plurality of support ribs 192 cross each other at an angle other 90 degrees. More specifically, the screening ribs 180 and the support ribs 192 can cross each other at an angle ranging from greater than 0 degrees up to less than 90 degrees. As shown in FIG. 9, for example, the support ribs 192 cross the screening ribs 180 at an angle of approximately 45 degrees. Alternatively, the screening ribs 180 and the support ribs 192 may cross each other at an angle ranging from greater than 90 degrees up to less than 180 degrees. By orienting the support ribs 192 in different directions relative to the screening ribs 180, the screening panel 150 is further capable of reducing build-up of materials that flows through the screening panel 150 during the screening process, thereby improving the throughput of material particles by the screening panel 150. In alternative embodiments of the present disclosure, the support ribs 192 may extend in a parallel relationship relative to the screening ribs 180.

Referring back to FIG. 5, a cross-sectional view of the screening panel 150 of FIG. 2 along line 5-5 is illustrated. More specifically, one embodiment of the cross-sectional shapes 186, 194 of the screening ribs 180 and the support ribs 192, respectively are illustrated. As shown, the screening ribs 180 have a generally ovoid, or egg-shaped, cross-sectional shape 186. Such a cross-sectional shape, which has a radius non-tangential to the drafted flat edges, can help channel the material through the screening panel 150 and add wear to the material without tending to trap near-sized material within the screening panel 150. In still further embodiments, the cross-sectional shape 186 of the screening ribs 180 may have any other suitable shape known in the art, such as a rectangle, a circle, a trapezoid, a triangle, an oval, a square, or similar. Similarly and still referring to FIG. 5, the cross-sectional shape 194 of the support ribs 192 may be any suitable shape known in the art. For example, as shown, the support ribs 192 have a generally trapezoidal cross-sectional shape 194. In still additional embodiments, the support ribs 192 may have a square, rectangular, I-beam, triangular, round, or any other suitable cross-sectional shape.

Referring now to FIGS. 1-3 and 6-8, the screening panel 150 of the present disclosure may further include locating formations 169 provided on the outer peripheral surface of the peripheral frame 152. The locating formations 169 may be provided for engagement with complementary formations 169 on adjacent screening panels 150 to locate the screening panels 150 on the screening arrangement 100 (FIG. 1). In some embodiments, the locating formations 169 may be protrusions, as shown in FIGS. 1-2 and 6-8. Complementary protrusions may be brought into register with one another and fit into securing sockets 132 (FIG. 1) on the screening arrangement 100. Securing elements 140 may then be knocked into bores formed by the complementary protrusions, to secure the adjacent screening panels 150 on the screening arrangement 100. In other embodiments, the locating formations 169 may be recesses. Complementary recesses may be brought into register with one another, defining locating sockets into which complementary-shaped protrusions or spigots (not shown) are received to locate adjacent screening panels 150 on the screening arrangement 100.

Figure 10:
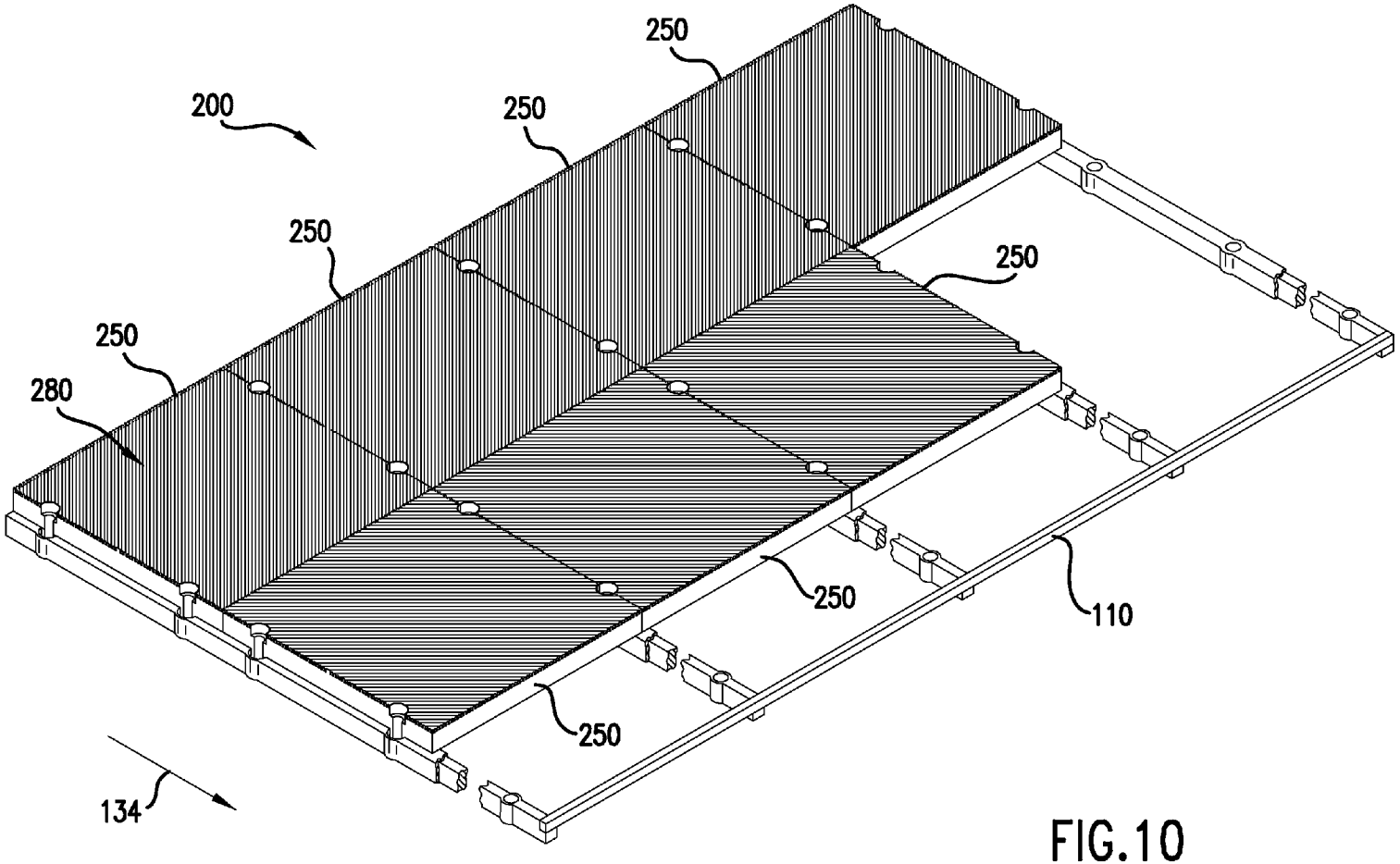
FIG. 10 illustrates a perspective view of a screening arrangement according to example aspects of the present disclosure.
Figure 11:
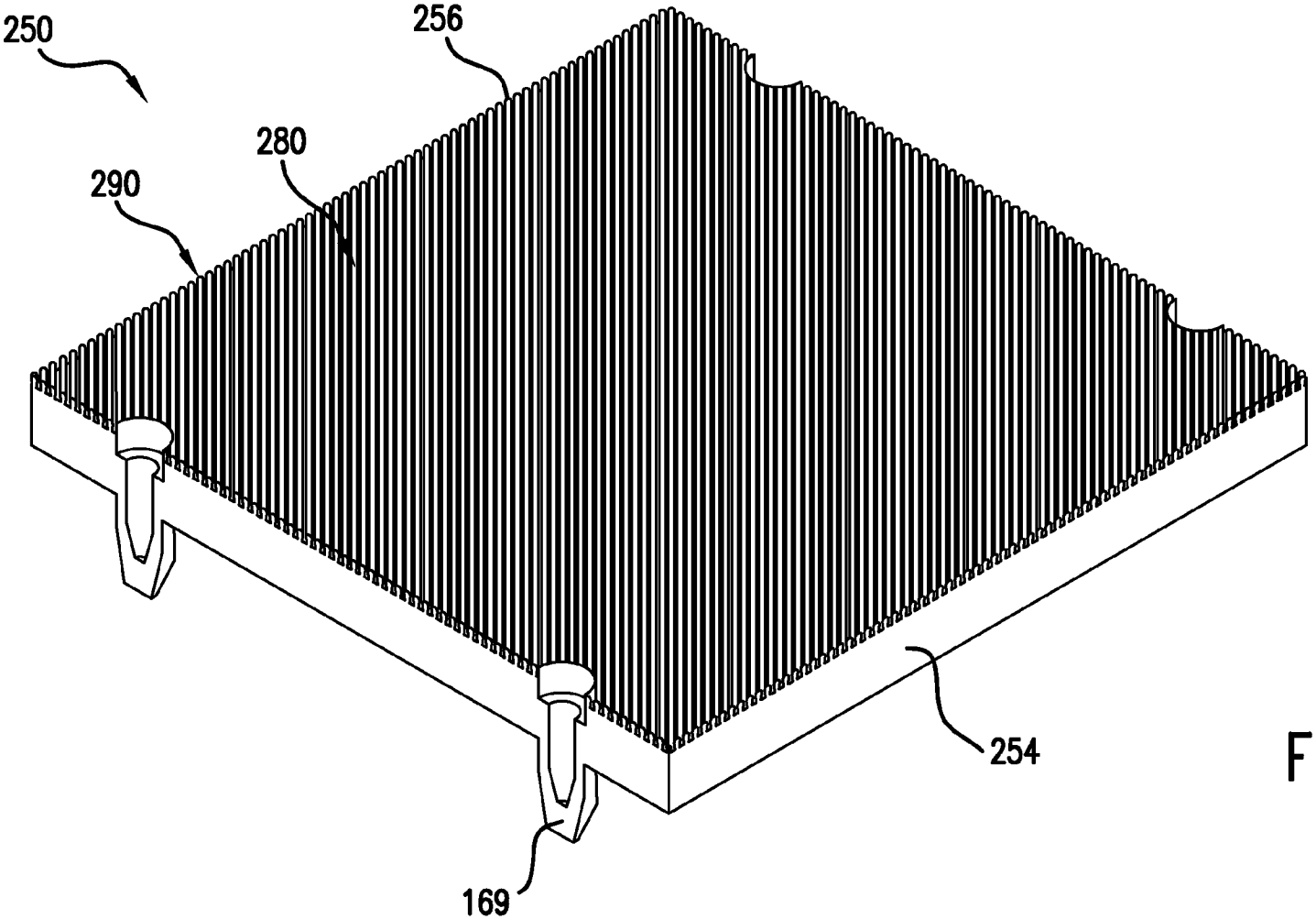
FIG. 11 illustrates a perspective view of a screening panel according to example aspects of the present disclosure.

Referring now to FIGS. 10 and 11, another embodiment of a screening panel arrangement 200 having a plurality of screening panels 250 is illustrated. As shown, each of the screening panels 250 define a screening surface 290 that is configured to facilitate the screening of material (not shown) through the screening panel 250. Further, the screening ribs 280 extend continuously across the screening surface 290 of the screening panel 250. More specifically, the screening ribs 280 extend diagonally from a first side frame member 256 continuously across the screening surface 290 of the screening panel 250. Further, in the illustrated embodiment, all of the screening ribs 280 on a single screening panel 250 are parallel to each other.

As shown in FIG. 10, the screening panels 250 can be arranged in the screening arrangement 200 such that the screening ribs 280 of one of the plurality of screening panels 250 extend in a different direction than adjacent screening ribs of an adjacent screening panel in the screening arrangement 200. As such, when material is screened through the screening arrangement 200, the material contacts the screening ribs 280 of one screening panel 250 in a first direction and then contacts an adjacent screening panel 250 having screening ribs 280 in a different second direction as the particles move along the flow direction 134. As such, if a near size particle follows the pattern of the present disclosure, the particle will travel farther than if traveling along a traditional screening panel.

Example embodiments of the present disclosure are discussed with reference to a screening panel having a single set of screening ribs extending in a direction non-parallel to the flow direction of material and to a screening panel having two sets of screening ribs extending in a direction non-parallel to the flow direction of material for purposes of illustration and discussion. Those of ordinary skill in the art, using the disclosures provided herein, will understand that a screening panel can include any number of sets of screening ribs extending in a direction non-parallel to the flow direction of material without deviating from the scope of the present disclosure.

In exemplary embodiments, the screening panels as described herein may be formed of any suitable material. For example, in various embodiments, the material may be formed of a resiliently deformable material. For example, in various embodiments, the resiliently deformable material may be a resiliently deformable polymeric material. In certain embodiments, the resiliently deformable material may include polyurethane. Further, in certain embodiments, the resiliently deformable material may include rubber. However, it should be understood that the present disclosure is not limited to the above disclosed materials. Rather, any suitable polymeric material or resiliently deformable material is within the scope and spirit of the present disclosure. Further it should be understood that the various components of the screening panel, such as the screening ribs and/or the support ribs, need not be formed of the same material, but rather may be formed from varying materials having varying desirable resilience characteristics.

In addition, the screening panel material may, in certain embodiments, have a Shore hardness in the range from approximately 40 Shore A to approximately 90 Shore A. In other embodiments, the screening panel material may have a Shore hardness in the range from approximately 60 Shore A to approximately 85 Shore A. However, it should be understood that the screening panel material of the present disclosure is not limited to Shore hardnesses in the range from approximately 40 Shore A to approximately 90 Shore A or approximately 60 Shore A to approximately 85 Shore A, but may be a material with any hardness above or harder than 90 Shore A or below or softer than 40 Shore A. Further it should be understood that the various components of the screening panel, such as the screening ribs and/or the support ribs, need not be formed of the same material, but rather may be formed from varying materials having varying desirable hardnesses.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A screening panel for screening materials, the screening panel comprising:

a peripheral frame comprising a first side frame member and an opposing second side frame member defining an opening therebetween;

a plurality of spaced elongated screening ribs defining a screening surface of the screening panel, the plurality of screening ribs comprising a first set of screening ribs and a second set of screening ribs, the first set of screening ribs extending from the first side frame member towards a transition portion of the screening surface in a first direction, the second set of the screening ribs extending from the transition portion towards the second side frame member in a second direction; and a plurality of elongated support ribs supporting the plurality of screening ribs;

wherein the first direction is different than the second direction.

2. The screening panel of claim 1, further comprising opposing first and second end frame members.

3. The screening panel of claim 2, wherein the first set of screening ribs extends diagonally from the first side frame member at an acute angle towards the first end frame member, and wherein the second set of screening ribs extends diagonally from the transition portion at an acute angle towards the second end frame member.

4. The screening panel of claim 1, wherein the second direction of the second set of screening ribs extends at an angle greater than 0 degrees but less than 180 degrees relative to the first direction of the first set of screening ribs.

5. The screening panel of claim 1, wherein the transition portion separates the first and second set of screening ribs.

6. The screening panel of claim 1, wherein the plurality of support ribs extends in a different direction than the plurality of screening ribs.

7. The screening panel of claim 1, wherein the plurality of screening ribs comprises one of the following cross-sectional shapes: an ovoid, a rectangle, a circle, a trapezoid, a triangle, an oval, or a square.

8. The screening panel of claim 1, wherein the plurality of support ribs comprises one of a square, rectangular, trapezoidal, 1-beam, or triangular cross-sectional shape.

9. A screening arrangement for screening materials, the screening arrangement comprising:

a support structure comprising a plurality of support members mounted in a parallel relationship to each other;

a plurality of screening panels mounted on the support members, each of the screening panels comprising:

a peripheral frame comprising a first side frame member and an opposing second side frame member defining an opening therebetween; and a plurality of spaced parallel elongated screening ribs defining a screening surface of the screening panel, the plurality of screening ribs extending continuously across at least a portion of the surface of the screening panel in a non-parallel direction relative to a flow direction of material along the screening arrangement.

10. The screening arrangement of claim 9, wherein one or more of the screening ribs of one of the plurality of screening panels extend in a different direction than adjacent screening ribs of an adjacent screening panel in the screening arrangement.

11. The screening arrangement of claim 10, wherein one or more of the screening ribs of one of the plurality of screening panels extend at an angle greater than 0 degrees but less than 180 degrees relative to the adjacent screening ribs on the adjacent screening panel.

12. The screening arrangement of claim 9, wherein each of the plurality of screening panels further comprises a plurality of elongated support ribs supporting the plurality of screening ribs.

13. The screening arrangement of claim 12, wherein one or more of the plurality of support ribs of one of the plurality of screening panels extends in a different direction than the plurality of screening ribs.

14. The screening arrangement of claim 12, wherein the plurality of support ribs extends in a parallel direction relative to the screening ribs.

15. A screening panel for screening materials, the screening panel comprising:

a peripheral frame comprising opposing first and second side frame members and opposing first and second end frame members, the frame members defining an opening therebetween; and a plurality of parallel spaced elongated screening ribs defining a screening surface of the screening panel, the plurality of screening ribs extending continuously across at least a portion of the screening surface in a direction that is diagonal relative peripheral frame;

wherein the plurality of screening ribs further comprises a first set of screening ribs and a second set of screening ribs, the first set of screening ribs extending diagonally from the first side frame member at an acute angle toward the first end frame member, the second set of screening ribs extending diagonally from a transition portion at an acute angle towards the second end frame member.

16. The screening panel of claim 15, wherein, when the screening panel is brought into register with an adjacent screening panel, one or more of the screening ribs are configured in a different direction than adjacent screening ribs on the adjacent screening panels.

* * * * *

UNITED STATES PATENT AND TRADEMARK OFFICE

CERTIFICATE OF CORRECTION

PATENT NO. : 8,967,388 B1
APPLICATION NO. : 14/103964
DATED : March 3, 2015
INVENTOR(S) : Parsons et al.

It is certified that error appears in the above-identified patent and that said Letters Patent is hereby corrected as shown below:

In the Claims

Claim 8, line 67 reads “dal, 1-beam” when it should be “dal, I-beam.”

Signed and Sealed this
Eleventh Day of August, 2015

Michelle K. Lee

Michelle K. Lee
*Director of the United States Patent and Trademark Office*